US008047796B2

(12) United States Patent
Riaz et al.

(10) Patent No.: US 8,047,796 B2
(45) Date of Patent: Nov. 1, 2011

(54) DOVETAIL ATTACHMENT FOR USE WITH TURBINE ASSEMBLIES AND METHODS OF ASSEMBLING TURBINE ASSEMBLIES

(75) Inventors: Muhammad Riaz, Niskayuna, NY (US); Dimitrios Stathopoulos, Delmar, NY (US); Vyacheslav Filyaev, Bristol (GB)

(73) Assignee: General Electric Company, Schenectady, NY (US)

( * ) Notice: Subject to any disclaimer, the term of this patent is extended or adjusted under 35 U.S.C. 154(b) by 1019 days.

(21) Appl. No.: 11/941,751

(22) Filed: Nov. 16, 2007

(65) Prior Publication Data

US 2009/0129932 A1 May 21, 2009

(51) Int. Cl.
*F01D 5/30* (2006.01)

(52) U.S. Cl. ..... 416/215; 416/219 R; 416/248

(58) Field of Classification Search ..... 416/219 R, 416/220 R, 221, 248, 215–218
See application file for complete search history.

(56) References Cited

U.S. PATENT DOCUMENTS

| | | | | | |
|---|---|---|---|---|---|
| 2,753,149 | A * | 7/1956 | Alexander | 416/216 |
| 4,191,509 | A * | 3/1980 | Leonardi | 416/219 R |
| 4,260,331 | A | 4/1981 | Goodwin | |
| 4,824,328 | A * | 4/1989 | Pisz et al. | 416/219 R |
| 5,110,262 | A * | 5/1992 | Evans | 416/219 R |
| 5,147,180 | A * | 9/1992 | Johnson | 416/219 R |
| 5,174,720 | A | 12/1992 | Gradl | |
| 5,494,408 | A | 2/1996 | Seeley et al. | |
| 5,531,569 | A | 7/1996 | Seeley | |
| 5,554,005 | A * | 9/1996 | Nguyen | 416/219 R |
| 6,142,737 | A | 11/2000 | Seeley et al. | |
| 6,435,833 | B1 | 8/2002 | Reluzco et al. | |
| 6,435,834 | B1 | 8/2002 | Reluzco et al. | |
| 6,652,237 | B2 | 11/2003 | Yehle et al. | |
| 2005/0175462 | A1 * | 8/2005 | Lagrange et al. | 416/219 R |
| 2009/0022591 | A1 * | 1/2009 | Mujezinovic et al. | 416/219 R |

* cited by examiner

*Primary Examiner* — Igor Kershteyn
(74) *Attorney, Agent, or Firm* — Armstrong Teasdale LLP

(57) ABSTRACT

A method of assembling a steam turbine including a rotor assembly is provided. The method includes providing at least one turbine bucket including a dovetail that includes a plurality of crush surfaces, a plurality of non-contact surfaces, and at least one neck defined between one of the crush surfaces and one of the non-contact surfaces. The method also includes providing a turbine wheel that includes at least one dovetail slot defined therein that is defined by a plurality of crush surfaces and a plurality of non-contact surfaces, and coupling the dovetail of the at least one turbine bucket within the turbine wheel slot such that a slant angle of the at least one neck facilitates a substantially uniform distribution of load between the dovetail and the at least one slot.

20 Claims, 5 Drawing Sheets

DOVETAIL ATTACHMENT FOR USE WITH TURBINE ASSEMBLIES AND METHODS OF ASSEMBLING TURBINE ASSEMBLIES

BACKGROUND OF THE INVENTION

This invention relates generally to steam turbines and, more specifically, to attaching steam turbine buckets to steam turbine wheels.

At least some known steam turbine buckets are subjected to high centrifugal loads. Specifically, buckets located in the last few stages of low pressure wheels may be more stressed than buckets in other stages due to centrifugal loads caused by rotation of steam turbine wheels. Such loads induce higher average and local stresses in the connective dovetails. Stress corrosion cracking (SCC) in the low pressure buckets is a serious concern and is driven largely by local stresses. As such, higher local stresses can lead to lower fatigue life of wheel and bucket dovetails. With an increasing demand for longer and longer buckets, the dovetails are required to operate under higher loads.

For at least some known low pressure turbines, the rotor wheel may be more limiting than the bucket. Specifically, the material used to manufacture at least some known buckets is more resistant to SCC than the material used for wheels. An effective means of avoiding SCC failure in low pressure wheels may be to reduce the local stresses in the wheel dovetail.

BRIEF DESCRIPTION OF THE INVENTION

In one aspect, a method of assembling a steam turbine including a rotor assembly is provided. The method includes providing at least one turbine bucket including a dovetail that includes a plurality of crush surfaces, a plurality of non-contact surfaces, and at least one neck defined between one of the crush surfaces and one of the non-contact surfaces. The method also includes providing a turbine wheel that includes at least one dovetail slot defined therein that is defined by a plurality of crush surfaces and a plurality of non-contact surfaces, and coupling the dovetail of the at least one turbine bucket within the turbine wheel slot such that a slant angle of the at least one neck facilitates a substantially uniform distribution of load between the dovetail and the at least one slot.

In another aspect, a dovetail assembly for a turbine is provided. The dovetail assembly includes a bucket dovetail and a wheel dovetail slot sized to receive the bucket dovetail. The bucket dovetail and wheel dovetail slot each include a plurality of crush surfaces, a plurality of non-contact surfaces, and a plurality of necks defined by a transition from a crush surface to a non-contact surface. Each neck includes a slant angle that facilitates distributing a substantially uniform load between the bucket dovetail and the wheel dovetail slot.

In another aspect, a steam turbine includes a rotor assembly having a plurality of turbine buckets coupled to a turbine wheel. Each turbine bucket includes an airfoil and a dovetail, and each turbine wheel includes a plurality of dovetail slots sized to receive the plurality of turbine bucket dovetails. Each bucket dovetail and each dovetail slot includes a plurality of crush surfaces, a plurality of non-contact surfaces, and a plurality of necks defined by a transition from a crush surface to a non-contact surface, and each neck includes a slant angle that facilitates distributing a substantially uniform load between a bucket dovetail and a respective wheel dovetail slot.

DETAILED DESCRIPTION OF THE INVENTION

At least one embodiment of the present invention is described below in reference to its application in connection with and operation of a steam turbine engine. Further, at least one embodiment of the present invention is described below in reference to a nominal size and including a set of nominal dimensions. However, it should be apparent to those skilled in the art and guided by the teachings herein provided that the invention is likewise applicable to any suitable turbine and/or engine. Further, it should be apparent to those skilled in the art and guided by the teachings herein provided that the invention is likewise applicable to various scales of the nominal size and/or nominal dimensions.

Figure 1:
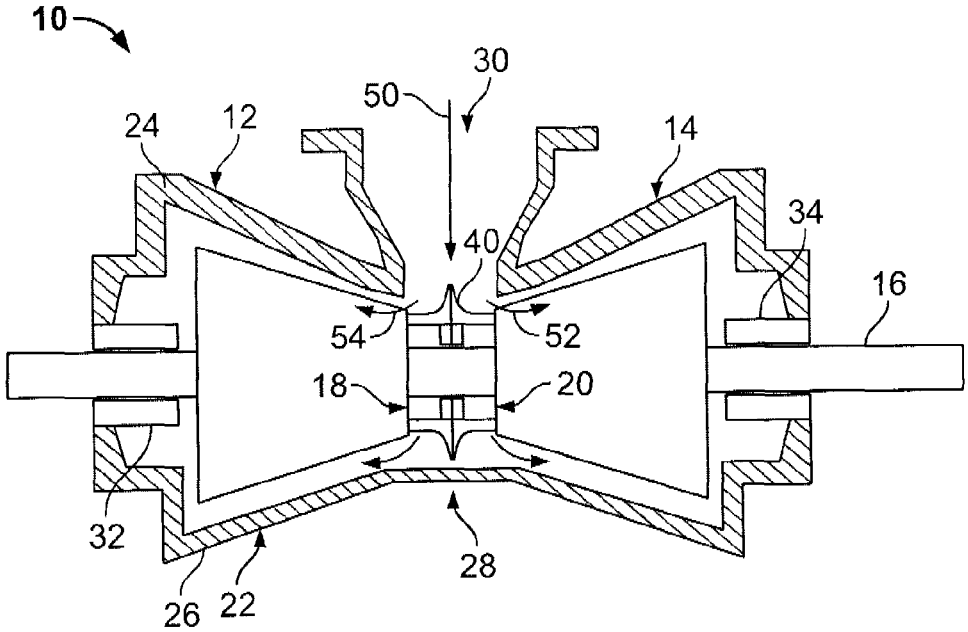
FIG. 1 is a schematic diagram of an exemplary opposed-flow steam turbine engine.

FIG. 1 is a schematic illustration of an exemplary opposed-flow steam turbine 10. Turbine 10 includes first and second low pressure (LP) sections 12 and 14. As is known in the art, each turbine section 12 and 14 includes a plurality of stages of diaphragms (not shown in FIG. 1). A rotor shaft 16 extends through sections 12 and 14. Each LP section 12 and 14 includes a nozzle 18 and 20. A single outer shell or casing 22 is divided along a horizontal plane and axially into upper and lower half sections 24 and 26, respectively, and spans both LP sections 12 and 14. A central section 28 of shell 22 includes a low pressure steam inlet 30. Within outer shell or casing 22, LP sections 12 and 14 are arranged in a single bearing span supported by journal bearings 32 and 34. A flow splitter 40 extends between first and second turbine sections 12 and 14.

During operation, low pressure steam inlet 30 receives low pressure/intermediate temperature steam 50 from a source, such as, but not limited to, an HP turbine or IP turbine through a cross-over pipe (not shown). Steam 50 is channeled through inlet 30 wherein flow splitter 40 splits the steam flow into two opposite flow paths 52 and 54. More specifically, in the exemplary embodiment, the steam 50 is routed through LP sections 12 and 14 wherein work is extracted from the steam to rotate rotor shaft 16. The steam exits LP sections 12 and 14 and is routed to a condenser, for example.

It should be noted that although FIG. 1 illustrates an opposed-flow, low pressure turbine, as will be appreciated by one of ordinary skill in the art, the present invention is not limited to being used only with low pressure turbines and can be used with any opposed-flow turbine including, but not limited to intermediate pressure (IP) turbines and/or high pressure (HP) turbines. In addition, the present invention is not limited to only being used with opposed-flow turbines, but rather may also be used with single flow steam turbines as well, for example.

Figure 2:
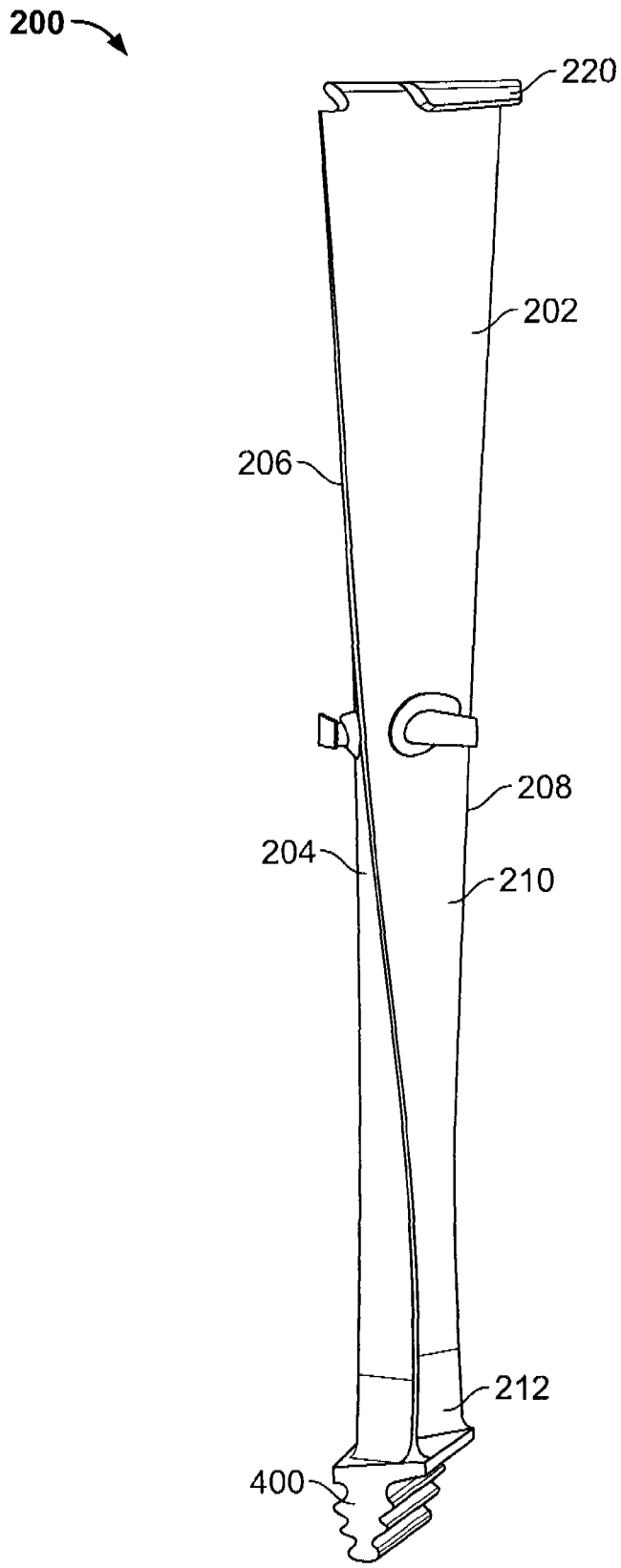
FIG. 2 is an illustration of an exemplary turbine bucket that may be used with the steam turbine shown in FIG. 1.

FIG. 2 is an illustration of an exemplary turbine bucket 200 that may be used with steam turbine 10 (shown in FIG. 1). Turbine bucket 200 includes a pressure side 202 and a suction side 204 connected together at a leading edge 206 and a trailing edge 208. Pressure side 202 is generally concave and suction side 204 is generally convex. Turbine bucket 200 is formed with a dovetail 400, an airfoil portion 210, and a root 212 extending therebetween. Airfoil portion 210 extends radially outward from root 212 and increases in length to a tip 220 of bucket 200. In the exemplary embodiment, airfoil portion 210, root 212, and dovetail 400 are all fabricated as a unitary component. In an alternative embodiment, airfoil portion 210 and root 212 may be fabricated from one unitary piece and then coupled to dovetail 400. In the exemplary embodiment, bucket 200 is coupled to rotor shaft 140 (shown in FIG. 1) via a dovetail assembly 600, described in more detail below, and extends radially outward from rotor shaft 140.

Figure 3:
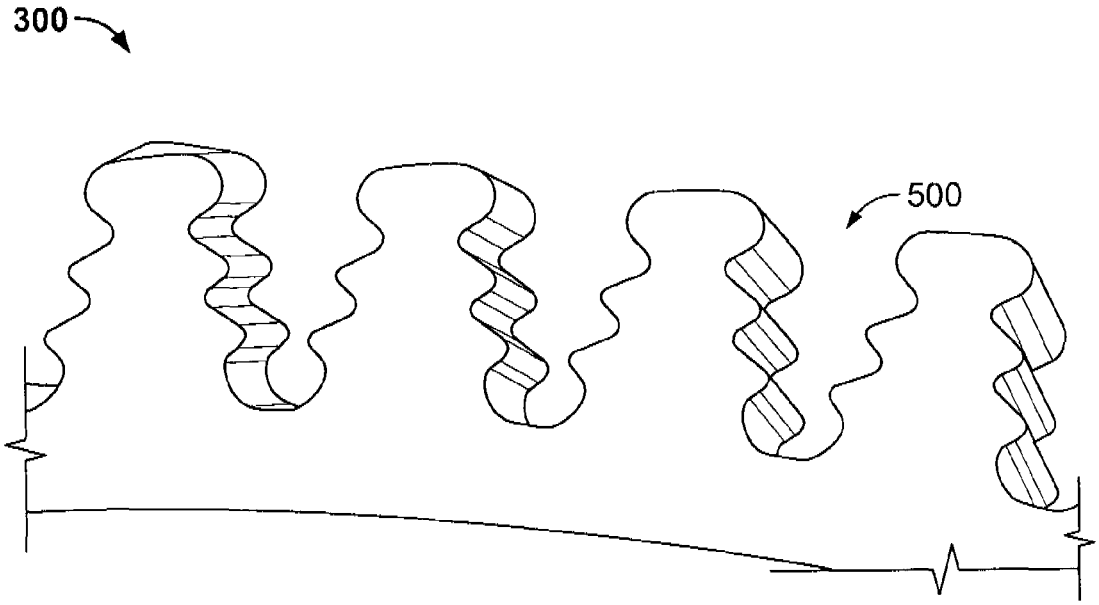
FIG. 3 is a perspective illustration of a portion of an exemplary turbine wheel that may be used with the bucket shown in FIG. 2.

FIG. 3 is a perspective illustration of a portion of an exemplary turbine wheel 300 that may be used with bucket 200 (shown in FIG. 2). Wheel 300 includes a plurality of circumferentially-aligned dovetail slots 500, described in more detail below. More specifically, slots 500 are spaced circumferentially about a radially outer periphery of wheel 300, and are shaped and sized to receive an attachment portion therein, such as bucket dovetail 400 (shown in FIG. 2) of bucket 200. More specifically, buckets 200 are removably coupled within each dovetail slot 500 by each respective bucket dovetail 400. As such, buckets 200 are operatively coupled to shaft 16 (shown in FIG. 1) via wheel 300.

Figure 4:
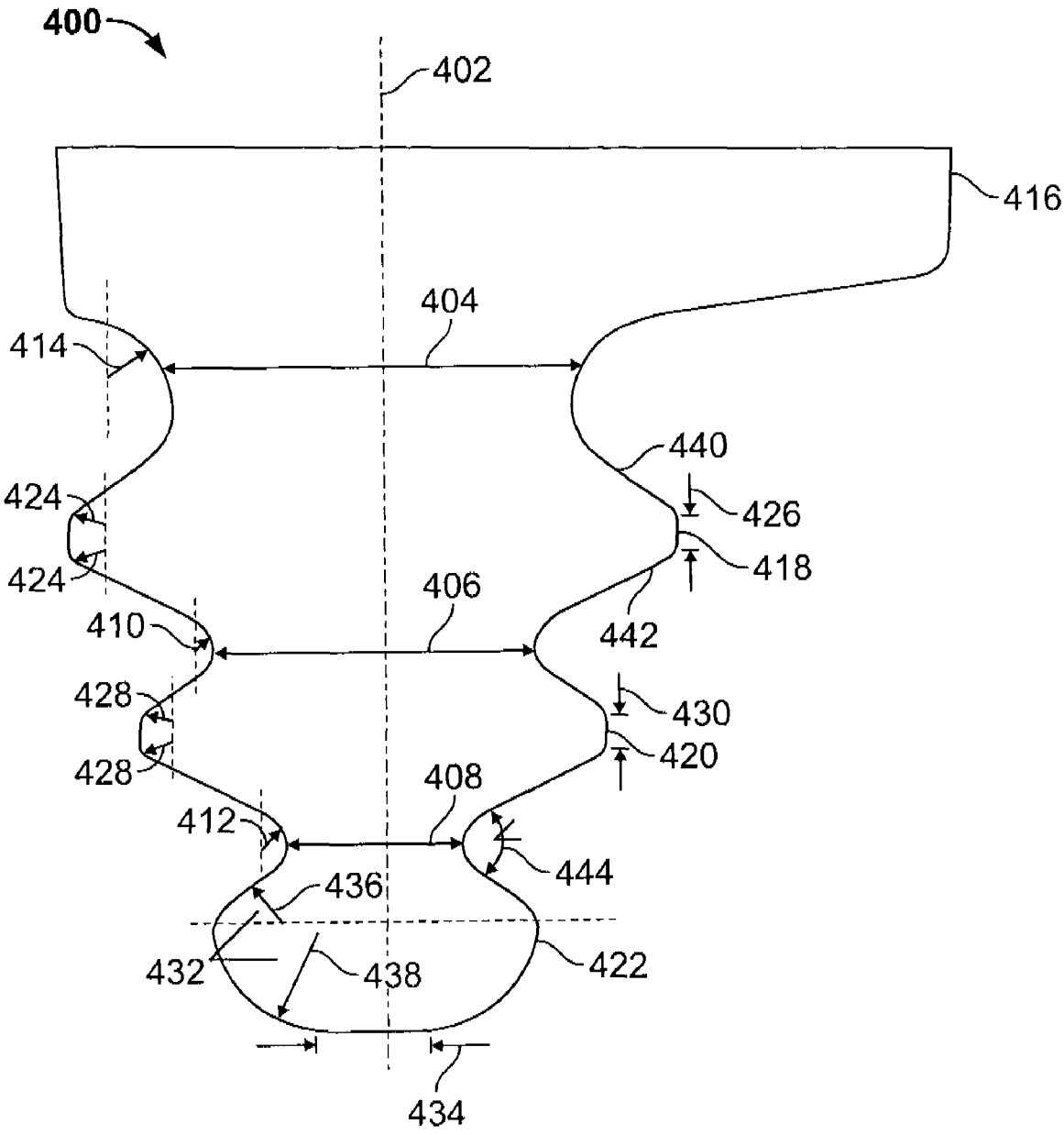
FIG. 4 is a schematic diagram of an exemplary turbine bucket dovetail that may be used with the bucket shown in FIG. 2.

FIG. 4 is a schematic view of bucket dovetail 400 that may be used with bucket 200 (shown in FIG. 2). In the exemplary embodiment, dovetail 400 is symmetric about a radial centerline 402. Alternative embodiments may alter the location of each element described below in relation to centerline 402. Dovetail 400 includes a plurality of neck fillets 404, 406, and 408. Specifically, in the exemplary embodiment, dovetail 400 includes a top neck fillet 404, a middle neck fillet 406, and a bottom neck fillet 408. Middle neck 406 is formed with a radius 410. Similarly, bottom neck 408 is also formed with a radius 412. In the exemplary embodiment, radii 410 and 412 are identical and each measures between 1.396 millimeters (mm) and 2.412 mm or, more specifically, approximately 1.904 mm. Alternative embodiments may vary the radius of each neck, either individually or in common. Top neck 404 is formed with a radius 414 which, in the exemplary embodiment, measures between 1.014 millimeters (mm) and 5.586 mm or, more specifically, approximately 3.300 mm. Alternative embodiments may use a different radius for the top neck. Radii 410, 412, and 414 are selected to facilitate reducing local stress concentration in dovetail 400. Radius 414 is further optimized to facilitate a smooth transition between dovetail 400 and a bucket dovetail platform 416.

In the exemplary embodiment, dovetail 400 also includes a plurality of hook fillets 418, 420, and 422. Specifically, dovetail 400 includes a top hook fillet 418, a middle hook fillet 420, and a bottom hook fillet 422. Top hook 418 is formed with two identical radii 424 and a flat surface 426 extending therebetween. Middle hook 420 is also formed with two identical radii 428 and a flat surface 430 extending therebetween. In the exemplary embodiment, radii 424 and 428 are identical and each measures between 0.425 millimeters (mm) and 1.441 mm or, more specifically, approximately 0.933 mm. Alternative embodiments may vary the radius of each hook, either individually or in common. In the exemplary embodiment, flat surfaces 426 and 430 each measure between 1.000 millimeters (mm) and 3.952 mm or, more specifically, approximately 1.412 mm. Alternative embodiments may use one or more flat surfaces that each have a different length.

Bottom hook 422 is formed with a compound radius 432 and a flat surface 434 that defines the bottom surface of dovetail 400. In the exemplary embodiment, compound radius 432 includes two radii 436 and 438. In the exemplary embodiment, radius 436 measures between 1.344 millimeters (mm) and 2.36 mm or, more specifically, approximately 1.852 mm. Radius 438 measures between 3.617 millimeters (mm) and 8.189 mm or, more specifically, approximately 5.903 mm. Alternative embodiments may include different radius measurements and/or may include bottom hook 422 including only a single radius. In the exemplary embodiment, flat surface 434 measures between 2.974 millimeters (mm) and 8.054 mm or, more specifically, approximately 5.514 mm. Alternative embodiments may include a flat surface having a different length.

Figure 5:
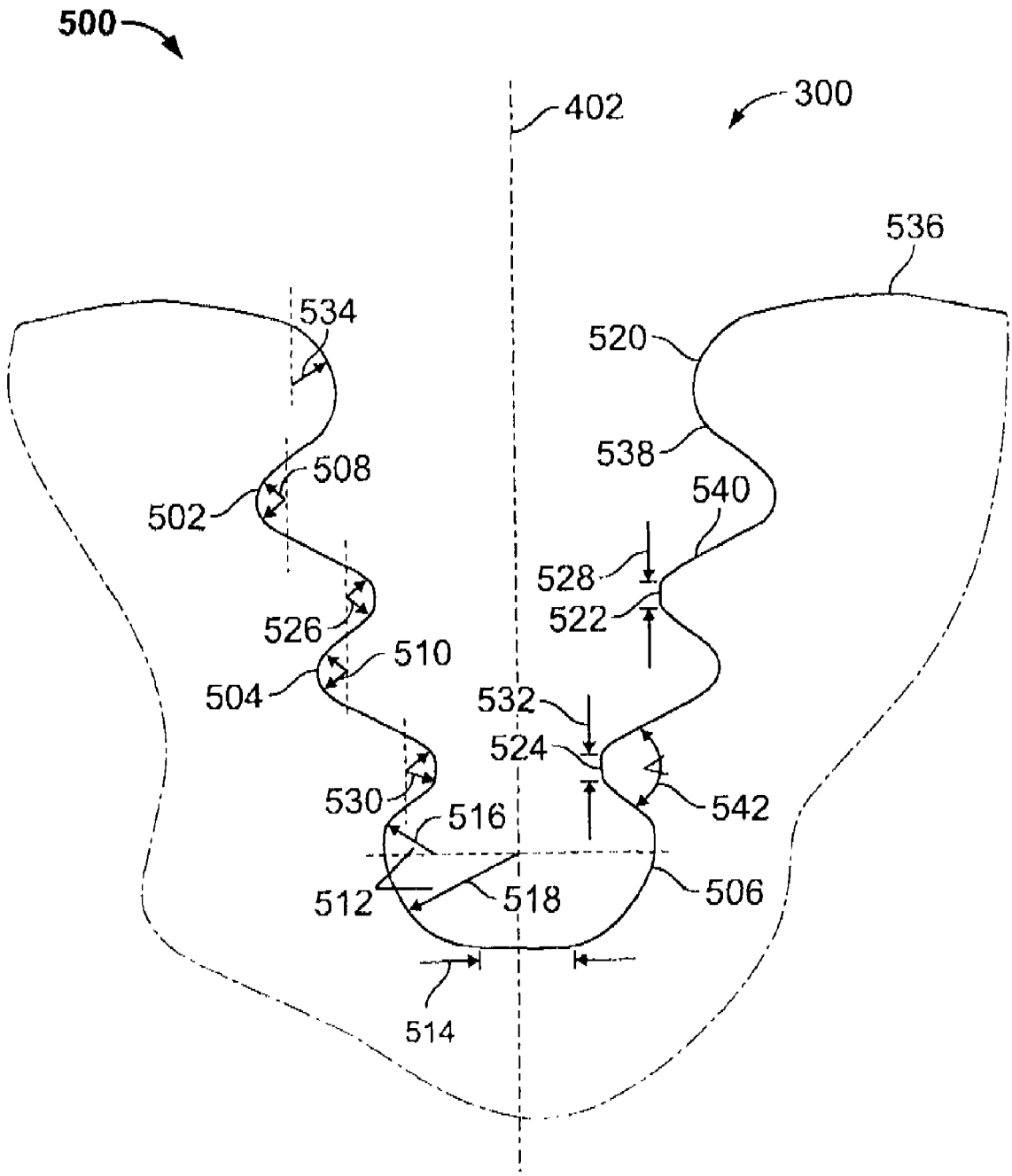
FIG. 5 is a schematic diagram of an exemplary turbine wheel dovetail slot that may be used with the wheel shown in FIG. 3.

FIG. 5 is a schematic view of an exemplary wheel dovetail slot 500 that may be defined in wheel 300. In the exemplary embodiment, slot 500 is symmetric about centerline 402 and is shaped complementary to bucket dovetail 400 (shown in FIG. 4). Alternative embodiments may alter the location of each element described below in relation to centerline 402. Slot 500 includes a plurality of neck fillets 502, 504, and 506. Specifically, in the exemplary embodiment, slot 500 includes a top neck fillet 502, a middle neck fillet 504, and a bottom neck fillet 506. Top neck 502 is formed with a radius 508, and middle neck 504 is formed with a radius 510. In the exemplary embodiment, radii 508 and 510 are identical and each measures between 1.690 millimeters (mm) and 2.706 mm or, more specifically, approximately 2.198 mm. Alternative embodiments may vary the radius of each neck 502 and/or 504. Bottom neck 506 is formed with a compound radius 512 and a flat surface 514 that defines the bottom surface of slot 500. In the exemplary embodiment, compound radius 512 includes two radii 516 and 518. Specifically, in the exemplary embodiment, radius 516 measures between 1.69 millimeters (mm) and 2.706 mm or, more specifically, approximately 2.198 mm. Radius 518 measures between 5.776 millimeters (mm) and 10.348 mm or, more specifically, approximately 8.062 mm. Alternative embodiments may include different radius measurements or may include bottom neck 506 including only a single radius.

In the exemplary embodiment, slot 500 also includes a plurality of hook fillets 520, 522, and 524. Specifically, in the exemplary embodiment, slot 500 includes a top hook 520, a middle hook 522, and a bottom hook 524. Middle hook 522 is formed with two identical radii 526 and a flat surface 528 extending therebetween. In the exemplary embodiment, each radius 526 measures between 1.604 millimeters (mm) and 2.62 mm or, more specifically, approximately 2.112 mm. Flat surface 528 measures between 0.250 millimeters (mm) and 3.393 mm or, more specifically, approximately 0.853 mm. Alternative embodiments may use one or more flat surfaces having a different length. Further, alternative embodiments may use a different radius or may use two different radii.

Bottom hook 524 is formed with two identical radii 530 and a flat surface 532 extending therebetween. In the exemplary embodiment, each radius 530 measures between 0.425 millimeters (mm) and 1.441 mm or, more specifically, approximately 0.933 mm. Flat surface 532 measures between 0.500 millimeters (mm) and 3.707 mm or, more specifically, approximately 0.663 mm. Alternative embodiments may use one or more flat surfaces having a different length. Further, alternative embodiments may use a different radius or may use two different radii. Each of middle hook 522 and bottom hook 524 are shaped to facilitate carrying load approximately equally. Top hook 520 includes a radius 534 which, in the exemplary embodiment, measures between 1.255 millimeters (mm) and 5.827 mm or, more specifically, approximately 3.541 mm. Alternative embodiments may use a different radius for top hook 520. Radius 534 is selected to facilitate a smooth transition between slot 500 a top wheel surface 536.

In the exemplary embodiment, and as shown in FIGS. 4 and 5, dovetail 400 and slot 500 also each include a plurality of crush surfaces 440 and 538 and non-contact surfaces 442 and 540. Specifically, in the exemplary embodiment, dovetail 400 includes a plurality of crush surfaces 440 and a plurality of non-contact surfaces 442. More specifically, each crush surface 440 is oriented on an axial-circumferential plane and is defined by a transition defined between a neck 404, 406, and/or 408, and a respective hook 418, 420, and/or 422. Each non-contact surface 442 is defined by a transition defined between a hook 418, 420, and/or 422 and a respective neck 404, 406, and/or 408. Slot 500 is also formed with a plurality of crush surfaces 538 and a plurality of non-contact surfaces 540. Specifically, each crush surface 538 is oriented on an axial-circumferential plane and is defined by a transition defined between a hook 520, 522, and/or 524 and a neck 502, 504, and/or 506. Each non-contact surface 540 is defined by a transition defined between a neck 502, 504, and/or 506 and respective a hook 520, 522, and/or 524. In the exemplary embodiment, each crush surface 440 and 538 is oriented such that a transition angle 444 and 542 defined between a crush surface 440 and 538 and a non-contact surface 442 and 540 measures between 50.0° and 90.0° or, more specifically, approximately 70.6°. Such a transition angle is known as the slant angle. Alternative embodiments may include a different angle measurement.

Figure 6:
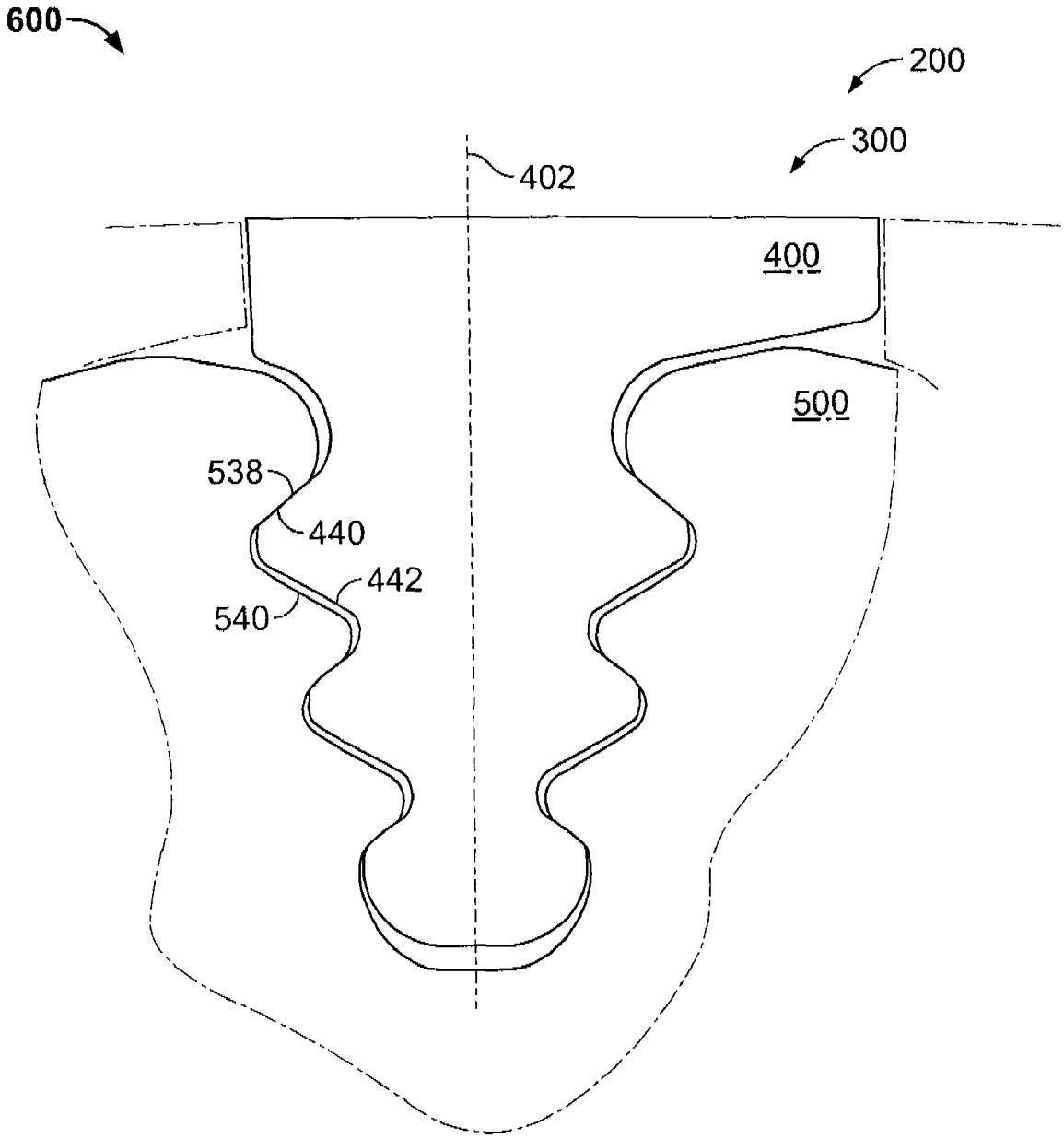
FIG. 6 is a schematic diagram of an exemplary dovetail assembly including the dovetail shown in FIG. 4 and the dovetail slot shown in FIG. 5.

FIG. 6 a schematic view of an exemplary dovetail assembly 600 that may be used with bucket 200 and wheel 300. More specifically, FIG. 6 illustrates the relationship between crush surfaces 440 and 538 of bucket dovetail 400 and wheel dovetail slot 500. Moreover, FIG. 6 illustrates the relationship between non-contact surfaces 442 and 540 of dovetail 400 and slot 500, respectively.

During operation, rotation of wheel 300 causes centrifugal forces to develop in buckets 200, which are then transferred to each dovetail assembly 600 through crush surfaces 440 and 538. Such forces induce stresses in each dovetail assembly 600. Concentrated stress loading results when load paths are forced to change direction. As such, with a slanted crush surface, such as crush surfaces 440 and 538, the change in direction is less severe and, as such, the resulting stress concentration is reduced. Additionally, a slant angle, such as slant angle 444 and 542, induces a component of the forces in an axial direction, giving rise to bending of bucket platform 416, further reducing stress concentration. Predetermined radius values in the hook fillets 418, 420, 422, 520, 522, and/or 524 and neck fillets 404, 406, 408, 502, 504, and/or 506 further mitigate stresses caused by the centrifugal forces generated by wheel 300 by allocating in a more equal fashion the stresses on each of the hook and neck fillets.

The above-described methods and apparatus facilitate minimizing local stresses in bucket and wheel neck fillets caused by the high centrifugal force induced to buckets. An optimized slant angle and optimized fillet radii facilitate uniformly distributing the load on the dovetail assembly, thereby resulting in low local and average stresses in both the bucket dovetail and the wheel dovetail slot. Such a reduction in stress concentration facilitates carrying higher centrifugal loads giving improved power output.

Exemplary embodiments of methods and apparatus that facilitate minimizing local stresses in a dovetail assembly are described above. The methods and apparatus are not limited to the specific embodiments described herein, but rather, components of the methods and apparatus may be utilized independently and separately from the other components described herein. For example, the dovetail assembly described herein for use in a power plant may also be fabricated and/or used in combination with other industrial plant or component design and/or monitoring systems and methods, and is not limited to practice with only power plants generically or to steam turbine engines specifically, as described herein. Rather, the present invention can be implemented and utilized in connection with many other component or plant designs and/or systems.

While the invention has been described in terms of various specific embodiments, those skilled in the art will recognize that the invention can be practiced with modification within the spirit and scope of the claims.

What is claimed is:

1. A method of assembling a steam turbine including a rotor assembly, said method comprising:

providing at least one turbine bucket including a dovetail that includes a plurality of crush surfaces, a plurality of non-contact surfaces, and at least one neck defined between one of the crush surfaces and one of the non-contact surfaces, wherein the at least one neck extends at a slant angle that is defined between the crush surface and the non-contact surface;

providing a turbine wheel that includes at least one dovetail slot defined therein that is defined by a plurality of crush surfaces and a plurality of non-contact surfaces;

forming in the dovetail a top bucket hook including two radii and a flat surface extending therebetween;

forming, in the dovetail, a middle bucket hook including two radii and a flat surface extending therebetween, wherein the middle bucket hook radii are identical to the top bucket hook radii; and coupling the dovetail of the at least one turbine bucket within the turbine wheel slot such that the slant angle of the at least one neck facilitates a substantially uniform distribution of load between the dovetail and the at least one slot.

2. A method in accordance with claim 1 wherein providing at least one turbine bucket including a dovetail further comprises forming into the dovetail:

a bottom hook including a compound radius, wherein the middle hook is disposed between the top hook and the bottom hook.

3. A method in accordance with claim 1 wherein providing a turbine wheel that includes at least one dovetail slot further comprises forming into the at least one slot:

a top wheel hook including a radius;

a middle wheel hook including two radii and a flat surface extending therebetween; and a bottom wheel hook including two radii and a flat surface extending therebetween.

4. A method in accordance with claim 1 wherein providing a turbine wheel further comprises providing a turbine wheel including a slant angle defined between a crush surface of the plurality of crush surfaces and a non-contact surface of the plurality of non-contact surfaces, wherein the slant angle measures approximately 70.6 degrees.

5. A method in accordance with claim 1 wherein providing at least one turbine bucket further comprises providing at least one turbine bucket that includes at least one neck that extends at a slant angle that measures approximately 70.6 degrees.

6. A method in accordance with claim 3 wherein providing at least one turbine bucket including a dovetail further comprises forming into the dovetail a plurality of hooks and a plurality of necks, wherein each hook has a predetermined thickness and each neck has a predetermined length to facilitate minimizing local stress in the hooks.

7. A method in accordance with claim 5 wherein providing a turbine wheel that includes at least one dovetail slot further comprises forming into the at least one slot a plurality of hooks and a plurality of necks, wherein each hook has a predetermined thickness and each neck has a predetermined length to facilitate minimizing local stress in the hooks.

8. A dovetail assembly for a turbine, said dovetail assembly comprising a bucket dovetail and a wheel dovetail slot sized to receive said bucket dovetail, said bucket dovetail and wheel dovetail slot each comprising a plurality of crush surfaces, a plurality of non-contact surfaces, and a plurality of necks defined by a transition from a crush surface to a non-contact surface, wherein each neck extends at a slant angle that is defined between said crush surface and said non-contact surface and said slant angle facilitates distributing a substantially uniform load between said bucket dovetail and said wheel dovetail slot, wherein said bucket dovetail further comprises:

a top bucket hook comprising at least two radii and at least one flat surface extending therebetween; and a middle bucket hook comprising at least two radii and at least one flat surface extending therebetween.

9. A dovetail assembly in accordance with claim 8 wherein said bucket dovetail further comprises:

a bottom hook comprising a compound radius, wherein said middle hook is disposed between the top hook and the bottom hook.

10. A dovetail assembly in accordance with claim 8 wherein said dovetail slot further comprises:

a top wheel hook comprising a radius;

a middle wheel hook comprising at least two radii and at least one flat surface extending therebetween; and a bottom wheel hook comprising at least two radii and at least one flat surface extending therebetween.

11. A dovetail assembly in accordance with claim 9 wherein said slant angle that is defined between said crush surface and said non-contact surface of said bucket dovetail measures approximately 70.6 degrees.

12. A dovetail assembly in accordance with claim 9 wherein said slant angle that is defined between said crush surface and said non-contact surface of said dovetail slot measures approximately 70.6 degrees.

13. A dovetail assembly in accordance with claim 8 wherein each said neck is optimized to improved resistance to shear stresses.

14. A steam turbine comprising a rotor assembly comprising a plurality of turbine buckets coupled to a turbine wheel, said plurality of turbine buckets each comprising an airfoil and a dovetail, said turbine wheel comprising a plurality of dovetail slots sized to receive said plurality of turbine bucket dovetails, each said bucket dovetail and dovetail slot comprising a plurality of crush surfaces, a plurality of non-contact surfaces, and a plurality of necks defined by a transition from a crush surface to a non-contact surface, wherein each neck extends at a slant angle that is defined between said crush surface and said non-contact surface and said slant angle facilitates distributing a substantially uniform load between said bucket dovetail and said wheel dovetail slot, wherein each said turbine bucket dovetail further comprises:

a top bucket hook comprising at least two radii and a flat surface extending therebetween; and a middle bucket hook comprising at least two radii and a flat surface extending therebetween.

15. A steam turbine in accordance with claim 14 wherein each said turbine bucket dovetail further comprises:

a bottom hook comprising a compound radius, wherein said middle hook is disposed between the top hook and the bottom hook.

16. A steam turbine in accordance with claim 14 wherein each said dovetail slot further comprises:

a top wheel hook comprising a radius;

a middle wheel hook comprising at least two radii and a flat surface extending therebetween; and a bottom wheel hook comprising at least two radii and a flat surface extending therebetween.

17. A steam turbine in accordance with claim 15 wherein said slant angle that is defined between said crush surface and said non-contact surface of said turbine bucket measures approximately 70.6 degrees.

18. A steam turbine in accordance with claim 16 wherein said slant angle that is defined between said crush surface and said non-contact surface of said dovetail slot measures approximately 70.6 degrees.

19. A steam turbine in accordance with claim 15 wherein each said bucket dovetail further comprises a plurality of hooks of varying thickness and a plurality of necks of varying lengths to facilitate minimizing local stress in said hooks.

20. A steam turbine in accordance with claim 16 wherein each said wheel dovetail slot further includes a plurality of hooks of varying thickness and a plurality of necks of varying lengths to facilitate minimizing local stress in said hooks.

* * * * *